US008240638B2

(12) United States Patent
Püttmann et al.

(10) Patent No.: US 8,240,638 B2
(45) Date of Patent: Aug. 14, 2012

(54) ROD ASSEMBLY DRIVER

(75) Inventors: Franz-Josef Püttmann, Lennestadt (DE); Gerhard Völkel, Erndtebrück (DE); Frank Prutti, Lennestadt (DE); Sebastian Leier, Schmallenberg (DE)

(73) Assignee: Tracto-Technik GmbH & Co. KG, Lennestadt (DE)

( * ) Notice: Subject to any disclaimer, the term of this patent is extended or adjusted under 35 U.S.C. 154(b) by 704 days.

(21) Appl. No.: 12/410,833

(22) Filed: Mar. 25, 2009

(65) Prior Publication Data

US 2009/0255701 A1 Oct. 15, 2009

Related U.S. Application Data

(63) Continuation of application No. PCT/EP2007/008013, filed on Sep. 14, 2007.

(30) Foreign Application Priority Data

Sep. 25, 2006 (DE) ..... 10 2006 045 557

(51) Int. Cl.
*B25B 33/00* (2006.01)

(52) U.S. Cl. ..... 254/29 R; 254/30; 254/131

(58) Field of Classification Search ..... 254/29 A, 254/30, 131, 133 R, 134; 173/171
See application file for complete search history.

(56) References Cited

U.S. PATENT DOCUMENTS

| | | | | |
|---|---|---|---|---|
| 1,427,699 | A | 8/1922 | Richter | |
| 1,724,814 | A | 8/1929 | Wolcott | |
| 2,310,960 | A | 2/1943 | Joahnsen | |
| 3,022,042 | A | 2/1962 | Orcutt | |
| 5,167,288 | A * | 12/1992 | McNeil et al. | 173/55 |
| 5,770,006 | A * | 6/1998 | Andrew et al. | 156/499 |
| 6,334,376 | B1 * | 1/2002 | Torres | 81/372 |
| 7,059,587 | B1 * | 6/2006 | Fimple | 254/30 |
| 2009/0184450 | A1 * | 7/2009 | Wuerthner | 269/133 |
| 2009/0255701 | A1 * | 10/2009 | Puttmann et al. | 173/171 |

FOREIGN PATENT DOCUMENTS

| | | |
|---|---|---|
| EP | 0 055 267 | 7/1982 |
| EP | 0 694 675 | 1/1996 |

OTHER PUBLICATIONS

Tractuell, Magazin für Freunde der Tracto-Technik [Online], No. 35, Mar. 2003, p. 9.

* cited by examiner

*Primary Examiner* — Lee D Wilson
(74) *Attorney, Agent, or Firm* — Henry M. Feiereisen LLC

(57) ABSTRACT

A rod assembly driver which is alternately acting in two opposing directions includes two opposing grip jaws for a rod assembly, which grip jaws are hingedly connected to one another in the form of a parallelogram by pairs of plates.

3 Claims, 5 Drawing Sheets

ROD ASSEMBLY DRIVER

CROSS-REFERENCES TO RELATED APPLICATIONS

This application is a continuation of prior filed copending PCT International Application No. PCT/EP2007/008013, filed Sep. 14, 2007, which designated the United States and has been published as International Publication No. WO 2008/037360 and on which priority is claimed under 35 U.S.C. §120, and which claims the priority of German Patent Application, Serial No. 10 2006 045 557.6, filed Sep 25, 2006, pursuant to 35 U.S.C. 119(*a*)-(*d*).

The contents of International Application No. PCT/EP2007/008013 and German Patent Application, Serial No. 10 2006 045 557.6 are incorporated herein by reference in its entirety as if fully set forth herein.

BACKGROUND OF THE INVENTION

The present invention relates to a driver for a boring and/or ram boring device.

The following discussion of related art is provided to assist the reader in understanding the advantages of the invention, and is not to be construed as an admission that this related art is prior art to this invention.

A driver of a type involved here includes a rod assembly which operates in two opposite directions, whereby the operating force in each of the two directions is required to be transmitted reliably and rapidly by a common motion drive in each of the two directions.

In addition, the kinetic energy should be able to substantially act at any location of the rod assembly, normally a pipeline. This is typically implemented in known devices with the assistance of drivers or engagement edges on the rod assembly which are subjected not only to particular wear but may constitute also the cause for damage or accidents. Moreover, the driver must be positioned accurately in relation to the rod assembly and the connection between driver and rod assembly is difficult to realize.

Another problem associated with a driver of this type is the realization of a required sufficiently firm formfit in order to attain a secure grip of the rod assembly without slippage that results in damage to the rod assembly. In addition, the reversal of movement, for example when providing a pilot borehole in the one direction and reversing the direction when drawing in a pipeline, is technically very complex to implement.

Another approach involves the use of a tension clamp which enables a reliable force transfer when tackles are involved but is effective in only one direction even though practice requires two effective directions, namely pull and push.

It would therefore be desirable and advantageous to provide an improved rod assembly driver to obviate prior art shortcomings and to allow a reversal of movement in a simple manner in the absence of any measures on the pipeline.

SUMMARY OF THE INVENTION

According to one aspect of the present invention, a rod assembly driver comprising two opposing grip jaws hingedly connected to one another in the form of a parallelogram.

The grip jaws permit a rapid switchover from pull to push or vice versa and, through simple release, a reliable displacement of the driver on the rod assembly like an advance of the rod assembly for example.

According to another feature of the present invention, at least one driver housing can be provided with two opposing grip jaws which are guided by pins in slanted slots of the driver housing and which grip the rod assembly from two opposite sides and connect the rod assembly with the driver, without slippage but detachably. At least one of the driver housings should be provided with two opposing actuating pins which engage, for example, in a T-shaped raceway of a switching ring to thereby lock the driver and to define the switching motion of the grip jaws during switchover.

According to another feature of the present invention, the grip jaws can be arranged in a switching housing which surrounds the switching ring.

BRIEF DESCRIPTION OF THE DRAWING

Other features and advantages of the present invention will be more readily apparent upon reading the following description of currently preferred exemplified embodiments of the invention with reference to the accompanying drawing, in which.

DETAILED DESCRIPTION OF PREFERRED EMBODIMENTS

Figure 1:
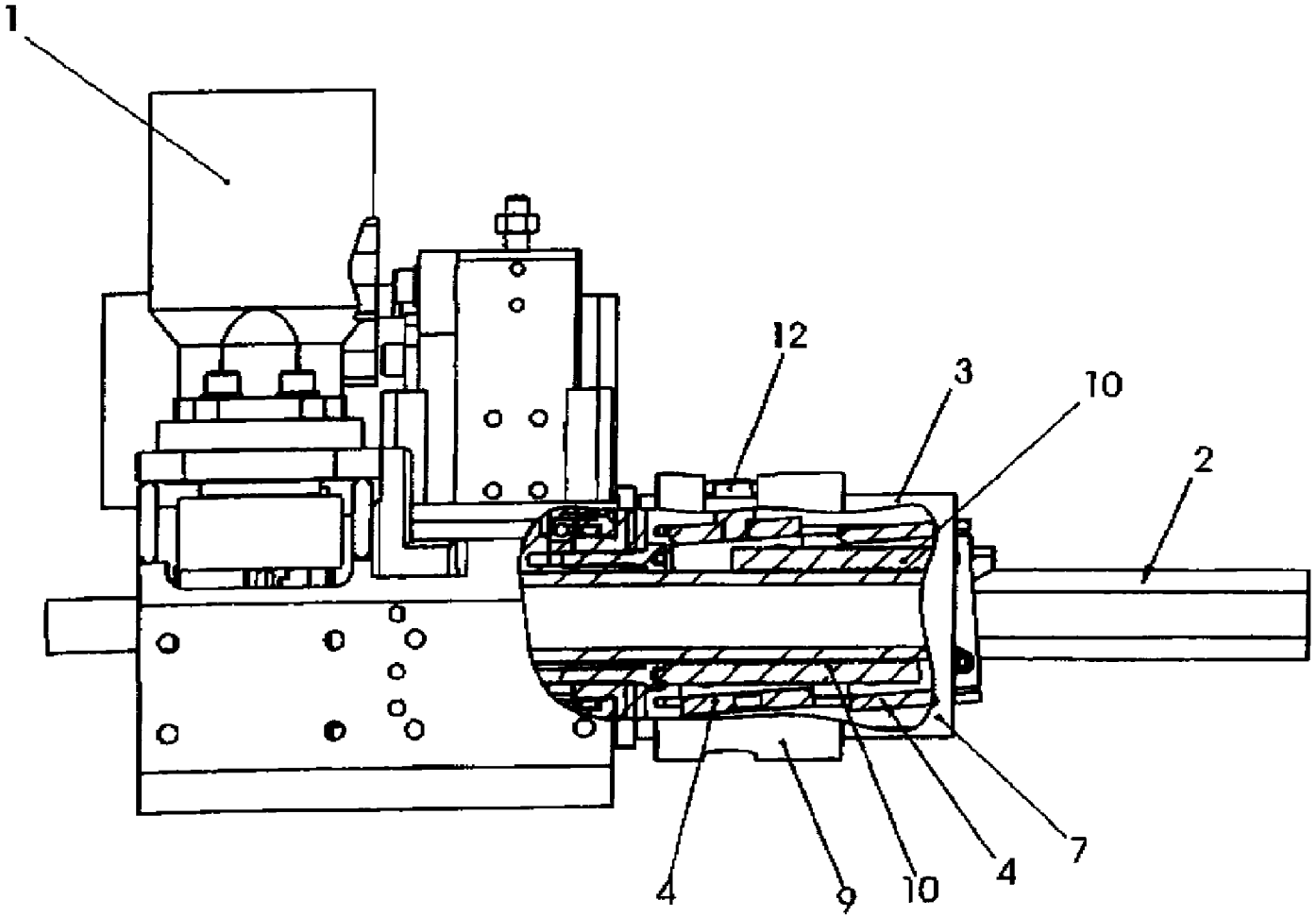
FIG. 1 is a schematic illustration of a boring and feed drive with a rod assembly driver.

Throughout all the figures, same or corresponding elements may generally be indicated by same reference numerals. These depicted embodiments are to be understood as illustrative of the invention and not as limiting in any way. It should also be understood that the figures are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted.

Turning now to the drawing, and in particular to FIG. 1, there is shown a schematic illustration of a boring and feed drive in the form of a ram boring device 1 which is not shown in greater detail and equipped with a rod assembly drive 3 according to the invention for installation of a pipe or rod assembly (drill rods) 2 into the ground.

The rod assembly drive 3 essentially includes two driver housings 4 arranged behind one another and linked to one another for operating in a same way. Each driver housing 4 has two opposing slanted slots 5 for engagement of pins 6 and grip jaws 10, 11 which are respectively arranged above and below the rod assembly 2 which is to be driven into the ground. The grip jaws 10, 11, are hereby hingedly connected to one another in the form of a parallelogram and able to grip the rod assembly 2 for incremental movement of the rod assembly 2. The driver housings 4 are swingably arranged inside a tubular switching housing 7 and each is clamped within the switching housing 7 by a plate 8, with the plates 8 extending through slots 19 of the switching housing 7. The ends of the plates 8 projecting out of the switching housing 7 to rest laterally on an end surface 20 of a rotatable switching ring 9, thereby securing the switching housing 7 in axial direction and the driver housing against rotation.

The switching ring 9 has two opposing T-shaped raceways 14, 15 which are arranged in 180° rotated relationship. Two actuating levers 12, 13 of the driver housing 4 end in the raceways 14, 15, respectively, and define pivot points about which the parallelogram configuration of driver housing 4 and grip jaws 10, 11 can move back and forth. The actuating levers 12, 13 have openings 16, 17, respectively, for application of a wrench.

Figure 2:
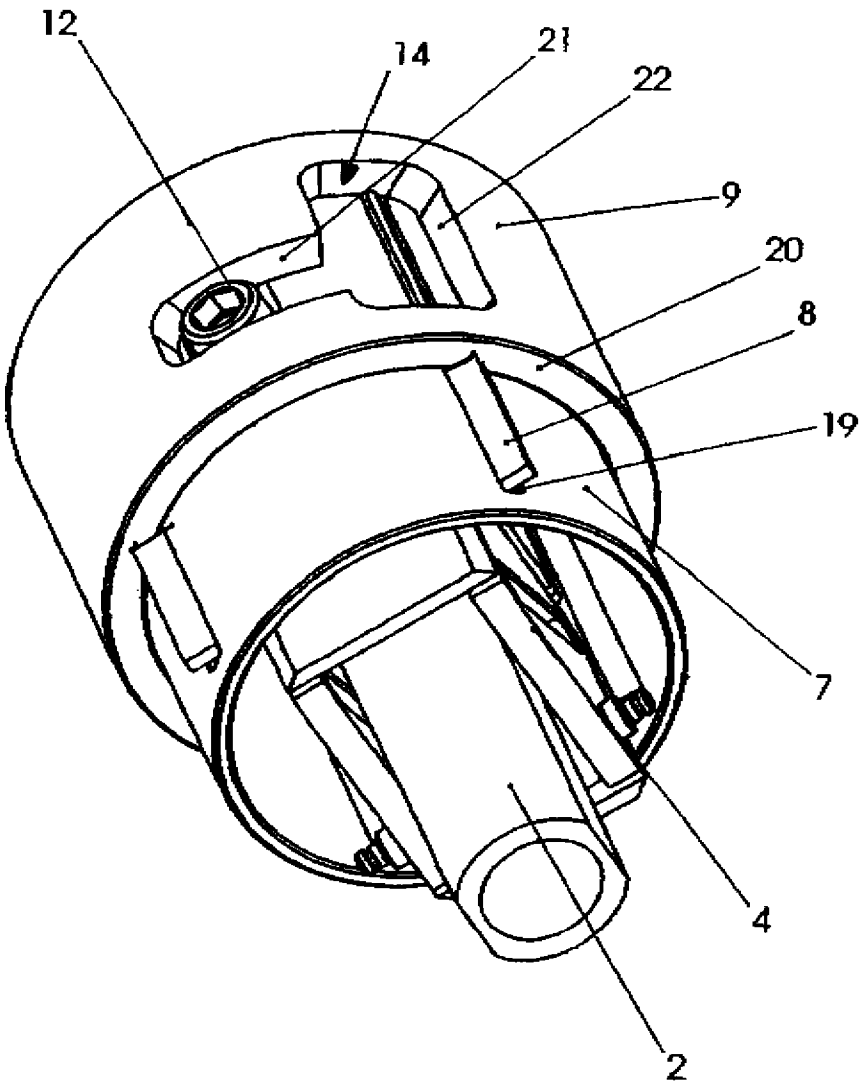
FIG. 2 a perspective view of a rod assembly driver.
Figure 3:
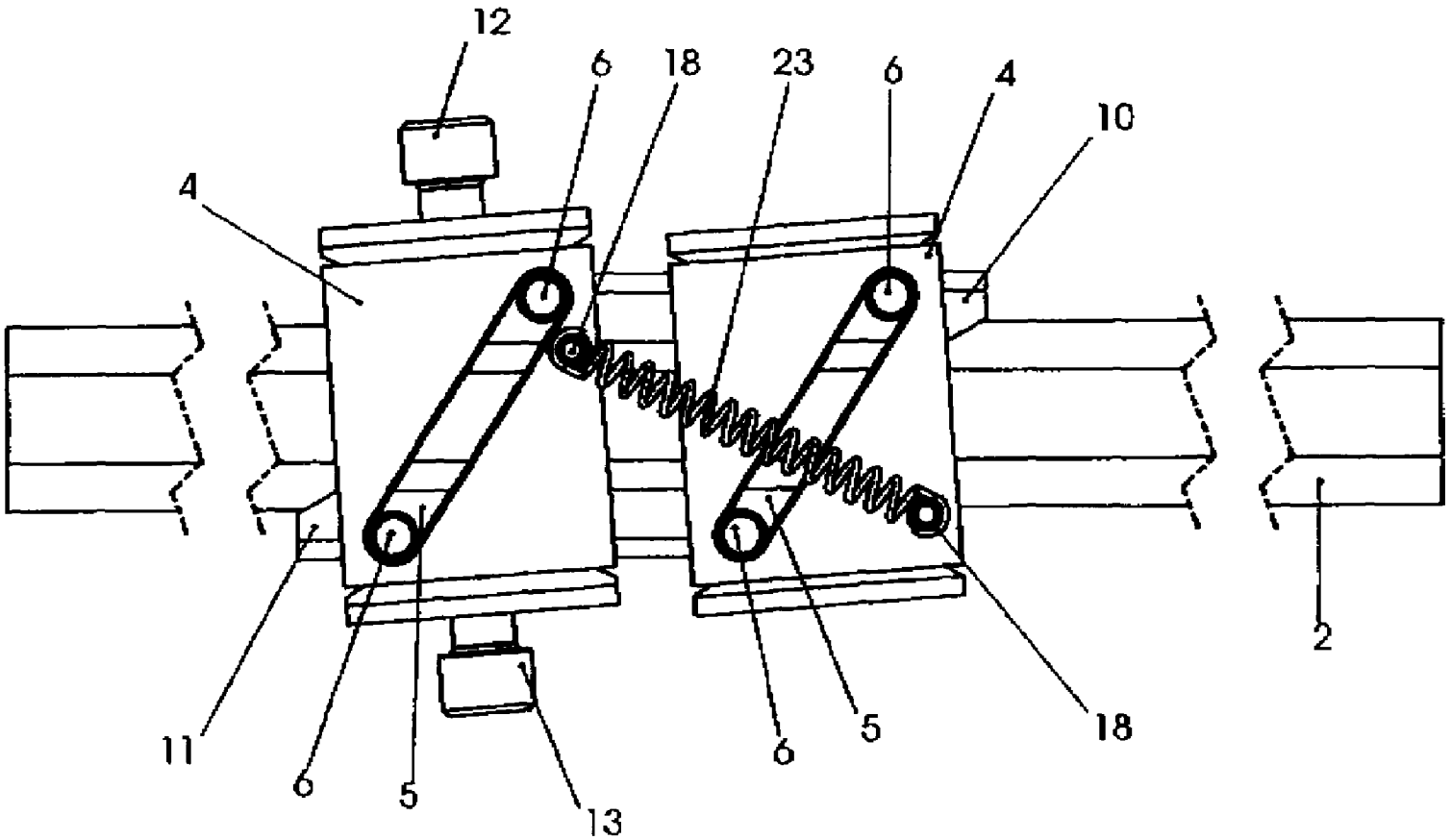
FIG. 3 a schematic view of two driver housings of the rod assembly driver.
Figure 4:
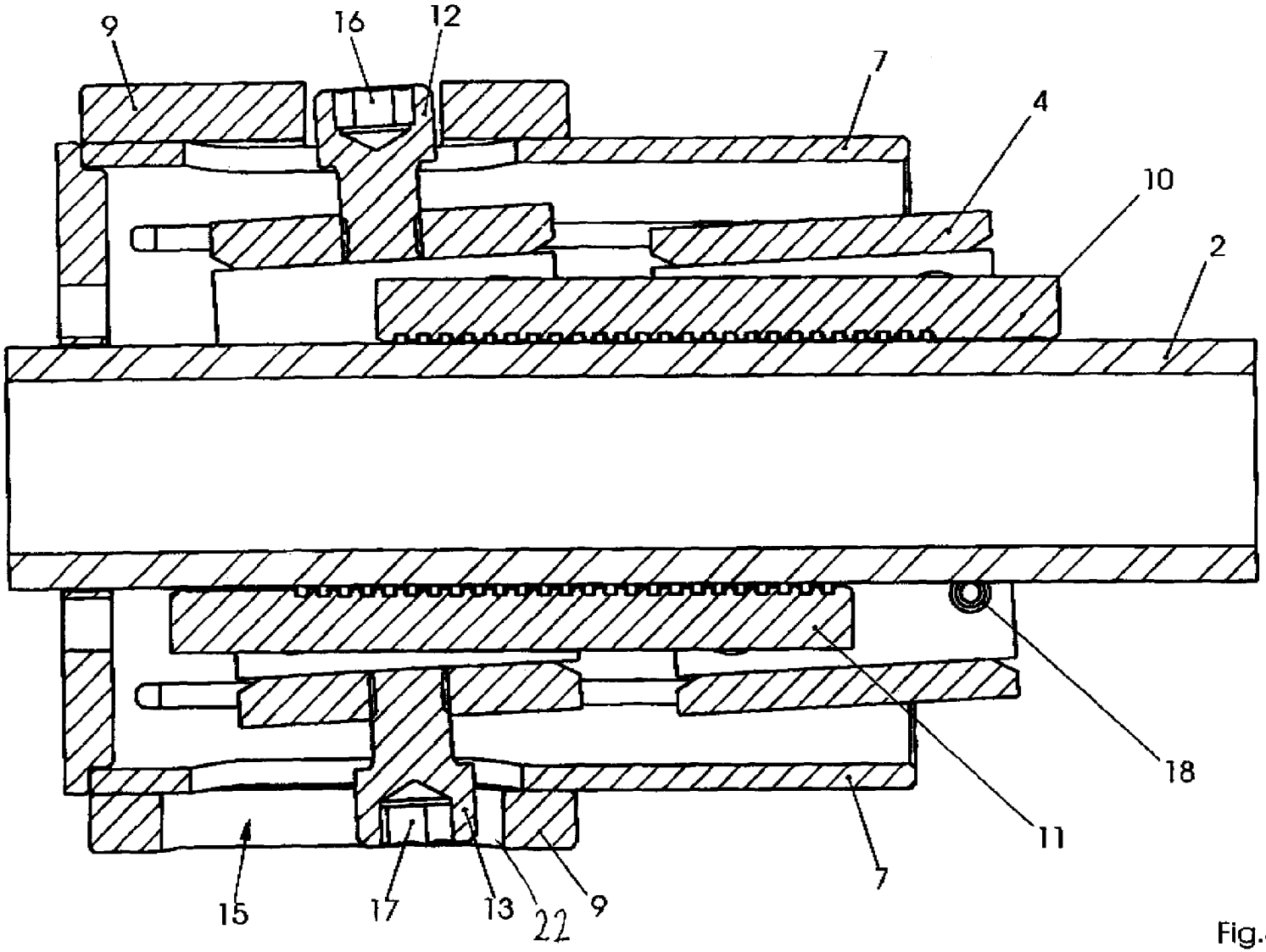
FIG. 4 a sectional view of the rod assembly driver in a position during pushing or boring to the right in the illustration.
Figure 5:
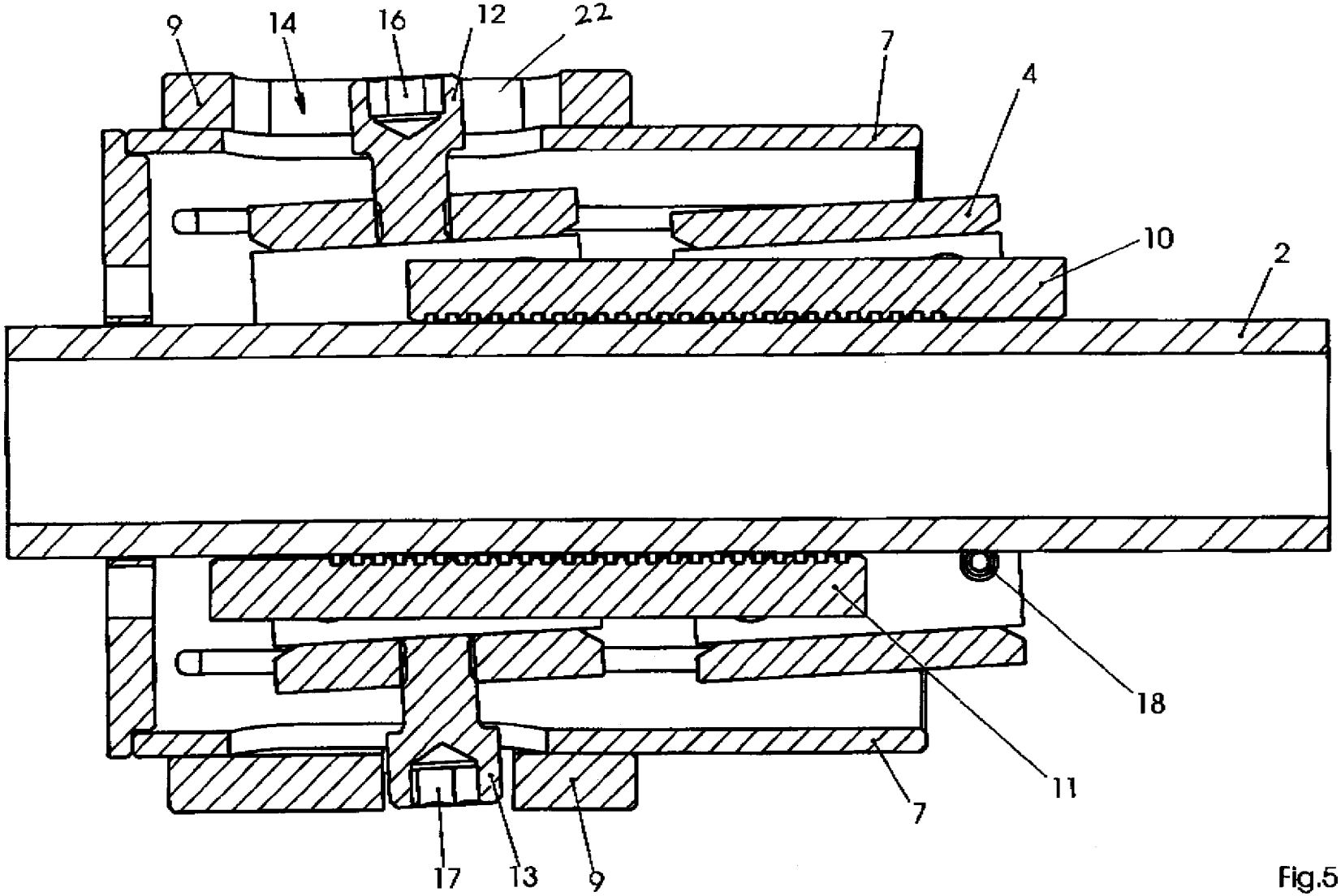
FIG. 5 a sectional view of the rod assembly driver in a position during reversal of the movement direction when pulling the rod assembly in opposition to the boring direction.

As a result, the actuating lever 12, which is connected to the driver housing 4, engages a transverse slot 21, whereas the other actuating lever 13, which is also connected to the driver housing 4, is received in a length slot 22 and is able to move back and forth during forward stroke and return stroke of the driver housing 4 in longitudinal direction of the rod assembly 2 to move the grip jaws 10, 11 in increments to the right into the gripping position, as shown in FIG. 4, as the driver housing 4 moves or to release it during the return or idle stroke. The illustrations in FIGS. 4 and 5 differ only in the effective direction of the grip jaws 10, 11 or driver housing 4 in response to which of the actuating levers 12, 13 is fixed in parallel relationship to the rod assembly axis (FIG. 2), i.e. the upper actuating lever 12 in the effective direction to the right (FIG. 4) and the lower actuating lever 13 in the effective direction to the left (FIG. 5). In FIG. 4, the actuating lever 12 defines the pivot point about which the grip jaws 10, 11 move, whereas in the illustration of FIG. 5, the actuating lever 13 defines the pivot point about which the grip jaws 10, 11 move.

Turning the switching ring 9 into one of its two positions (FIGS. 4, 5) allows a change in the effective direction of the rod assembly driver 3 between forward and rearward. In the position of FIG. 4, the actuating lever 12 is located in the switching ring raceway 14 in the position "pushing" and both grip jaws 10, 11 are offset in relation to one another in such a way that the rod assembly 2 is securely clamped in the operating direction to the right. Both grip jaws 10, 11 are continuously in contact with the rod assembly. The rod assembly driver 3 operates incrementally, i.e. the rod assembly 2, with the assistance of a stroke drive, one step forwards (or backwards). Once the stroke is exhausted, the rod assembly driver 3 returns to the starting position, while the rod assembly 2 is at rest, grips it anew to move it forwards (or backwards) again by an increment. Tension springs 23 extend between pins 18 in the driver housings 4 for stabilizing a position of the housing.

When changing a direction, the switching ring 9 is turned to thereby release the actuating lever 12 which thus no longer contacts the wall of the raceway 14 as it enters the length slot 22, while the actuating lever 13 is held stationary in the transverse slot 21 of the raceway 15.

Apart from its relative simplicity in structure, the advantage of the rod assembly driver resides in the ability to grip the rod assembly 2 in the absence of engagement edges so that the provision of a smooth tubular rod assembly without bumps is sufficient. A further essential advantage is the possibility to move the opened driver in both directions without conjointly moving the rod assembly.

While the invention has been illustrated and described in connection with currently preferred embodiments shown and described in detail, it is not intended to be limited to the details shown since various modifications and structural changes may be made without departing in any way from the spirit and scope of the present invention. The embodiments were chosen and described in order to explain the principles of the invention and practical application to thereby enable a person skilled in the art to best utilize the invention and various embodiments with various modifications as are suited to the particular use contemplated.

What is claimed as new and desired to be protected by Letters Patent is set forth in the appended claims and includes equivalents of the elements recited therein:

What is claimed is:

1. A rod assembly driver, comprising:

two opposing grip laws arranged in parallel relation and hingedly connected to one another;

at least one driver housing having two openings in opposing relationship for pins of the grip laws;

two actuating levers provided on the driver housing; and a switching ring provided on the driver housing and including T-shaped raceways for respective engagement by the actuating levers.

2. The rod assembly driver of claim 1, further comprising a switching housing, said grip jaws being arranged in the switching housing, with the switching ring disposed in surrounding relationship to the switching housing.

3. The rod assembly driver of claim 1, wherein the two opposing grip jaws are hingedly connected to one another in the form of a parallelogram.

* * * * *